US006142211A

United States Patent [19]

Judkins

[11] Patent Number: 6,142,211

[45] Date of Patent: Nov. 7, 2000

[54] SHADE OPERATOR WITH RELEASE BRAKE

[76] Inventor: Ren Judkins, 46 Newgate Rd., Pittsburgh, Pa. 15202

[21] Appl. No.: 09/371,434

[22] Filed: Aug. 10, 1999

[51] Int. Cl.[7] ..... E06B 9/56

[52] U.S. Cl. ..... 160/308; 160/319

[58] Field of Search ..... 160/291, 296, 160/298, 299, 305, 307, 308, 319, 321, 84.04, 84.05; 192/415, 8 C, 81 C

[56] References Cited

U.S. PATENT DOCUMENTS

| | | | |
|---|---|---|---|
| 203,414 | 5/1878 | Buckley et al. . | |
| 2,140,049 | 12/1938 | Grauel | 156/10 |
| 3,292,685 | 12/1966 | Clark | 160/26 |
| 4,372,432 | 2/1983 | Waine et al. | 192/8 |
| 4,427,100 | 1/1984 | Rude et al. | 192/43 |
| 4,433,765 | 2/1984 | Rude et al. | 192/41 |
| 4,651,854 | 3/1987 | Harada | 192/8 |
| 4,779,662 | 10/1988 | Wilk | 160/321 |
| 4,869,308 | 9/1989 | Chang | 160/176.1 |
| 4,869,357 | 9/1989 | Batchelder | 192/41 |
| 5,167,269 | 12/1992 | Abo | 160/305 |
| 5,314,053 | 5/1994 | Nishimura | 192/41 |
| 5,361,822 | 11/1994 | Nijs | 160/321 |
| 5,375,643 | 12/1994 | Rude | 160/321 |
| 5,482,105 | 1/1996 | Rude | 160/307 |
| 5,507,374 | 4/1996 | Rude | 192/8 |
| 5,542,464 | 8/1996 | Shiina | 160/296 |
| 5,628,356 | 5/1997 | Marocco | 160/170 |
| 5,647,421 | 7/1997 | Hoffmann et al. | 160/120 |

*Primary Examiner*—David M. Purol
*Attorney, Agent, or Firm*—Buchanan Ingersoll, P.C.

[57] ABSTRACT

An operator for a window covering held on a roller or axle has a stationary member having a central cavity and a first bore sized and positioned so that the roller can pass through the bore into the central cavity. A release brake is positioned so that the axle or roller can pass through and be held by the release brake. An inertial ring within the central cavity of the stationary member, surrounds a coil spring which encircles the axle. A release member is provided adjacent the release brake and the inertial ring. The release member is sized and positioned so that when the release ring is in a first position the release member will not engage the inertial ring or the release brake and when the release member is moved in a selected direction the release member will engage and turn the release brake and the inertial ring. A spool is positioned within the central cavity of the stationary member adjacent the inertial ring. A rewind spring is connected between the spool and the stationary member such that when a force acts on the spool to turn the spool in the first direction from the initial position the rewind spring will tighten and when the force is removed the spring will loosen causing the spool to return to the initial position.

9 Claims, 12 Drawing Sheets

SHADE OPERATOR WITH RELEASE BRAKE

FIELD OF THE INVENTION

The present invention relates to a device for operating and positioning a window covering, particularly a covering that is raised and lowered like a roller shade, a pleated shade, or a venetian blind.

DESCRIPTION OF THE PRIOR ART

In a roller shade window covering material is rolled and unrolled around a tubular core hung on brackets. Conventionally, a spring is provided within the core to raise and counterbalance the lowering of the shade. In a pleated or cellular shade, lift cords are rolled or unrolled about take up spools carried on a central shaft. Conventionally, the shaft, take up spools, and the shade operating mechanism is enclosed within a headrail which is hung on brackets. Additionally, a bottom rail is usually provided for added weight at the bottom of the shade to assist in lowering the window covering when the lift cords are unrolled and support the pleated or cellular material when lifted.

The prior art most commonly used for controlling the vertical position of a roller window shade is the ratchet and pawl mechanism. Examples of this mechanism are shown in U.S. Pat. Nos. 203,414 and 2,140,049. The ratchet and pawl mechanism has been in use for many years, but it is notoriously unpopular among users. Criticisms include the necessity of handling the shade material in order to operate the shade, and unreliable operation. Ratchet and pawl mechanisms are often difficult to engage and can only be set at heights corresponding to the tooth spacing of the ratchet. Many times the ratchet and pawl mechanism wears out before other components of the shade.

Another prior art device for controlling window shades is the friction brake. Examples of such brakes are disclosed in U.S. Pat. Nos. 5,184,660 and 5,482,105. These devices have a coiled spring between a central core and a sleeve. These devices apply a fixed torque to resist rotation of the shade roller no matter which direction the roller is turned. These devices suffer from the disadvantage that a substantial force is needed to raise the shade.

The prior art also contains examples of clutch mechanisms that are adapted for the operation of roller shades. Among these are U.S. Pat. Nos. 4,372,432 and 5,361,822. Prior art clutch mechanisms overcome some of the disadvantages of ratchet and pawl devices, but they have some disadvantages of their own. The clutch based devices are operated by a cord loop that hangs from one end of the shade roller. The cord loop eliminates the need for handling of the shade material or a protective shield attached thereto, and although the clutch mechanism allows the height of the shade to be set anywhere it requires the operator to estimate and set the length every operation cycle. It also permits the shade to be operated from one end rather than from the center which can be difficult to reach if the window is behind a piece of furniture. Also, clutch devices tend to be somewhat more expensive than the ratchet and pawl devices, and they require some amount of lost motion to insure proper operation. This lost motion is apparent when beginning to raise the shade. When the cord is first pulled, some motion is required before the shade begins to move. Also, the lost motion can contribute to an oscillating, or surging motion while the shade is lowered.

Clutches and friction brakes have also been used in pleated shades and venetian blinds where the lift cords are wound around a take-up roll located within the headrail. The take-up. roll is driven by a loop cord or motor. Motorized systems are significantly more expensive than cord operated systems. Loop cords and to a lesser extent lift cords and tilt cords hanging from the headrail have been the subject of much discussion concerning child safety. Children have been known to become entangled in hanging cords and particularly loop cords. As a result there is a demand for shorter cords and a prejudice against loop cords.

Consequently, there is a need for a shade operator having a reliable release brake that allows an operator to easily raise and lower shades to any desired position. Preferably, the shade operator should be easy and inexpensive to manufacture, not have any protruding components which could be broken off and not have loop cords or long cords extending from the headrail.

In my U.S. Pat. Nos. 5,741,393 and 5,927,370, as well as in my published patent application WO 99/25946, I disclose release brakes which have a stationary member, a movable member and a hub. A coil spring surrounds the hub and is connected between the movable member and the stationary member. Moving the movable member expands or contracts the diameter of the spring to grip or release the hub. An axle for a roller shade or pleated shade is connected to the hub. These shade operators use either a cord lop or a relatively long cord. Consequently, there is a need for a shade operator which can be used in conjunction with these release brakes and other types of release brakes to eliminate the cord loop and use a shorter cord.

SUMMARY OF THE INVENTION

I provide a shade operator having a release brake for a window covering of the type having an axle about which either a window covering material or lift cords are wound. The window covering is raised by pulling a spool cord attached to a spool and lowered by pulling a release cord attached to a release member preferably a release ring. There is a stationary member having a central cavity into which the axle can pass. Within the cavity there is a movable member through which the axle passes. I prefer to use a release brake of the type disclosed in my U.S. Pat. Nos. 5,791,393 and 5,927,370 and my published patent application WO 99/25946. In one embodiment of the present invention there is a movable member through which the axle passes. A spring is connected between the movable member which biases the movable member to grip the axle in one direction. An inertial ring is positioned adjacent to the release brake and has a central bore through which the axle passes. The axle is rotatably attached to the stationary member. I prefer to mount the axle on a post which extends from the stationary member into the cavity. A spool fits around the post and is positioned between the inertial ring and the end of the stationary member. A first spring having a selected diameter is fitted within the inertial ring member and lightly rubs on the exterior surface of axle. A first tang at one end of the spring is attached to the spool. A second tang at an opposite end of the spring is attached to the inertial ring so that one tang can be moved relative to the other tang to change the diameter of the spring. The spring is sized and positioned so that the spring will encircle and lightly press against the outside surface of the axle when in a relaxed condition. When the spool is turned in the direction to raise the shade the spring quickly changes diameter to bind the axle causing the axle to turn with the spool. But, when the spool turns in the opposite direction the spring changes diameter in the opposite direction and releases the axle. When the tangs of the spring are moved relative to one another to increase the diameter of the spring, the spring does not restrain movement of the axle. This allows the axle to turn freely. Then the lift cords on the axle or the shade is wound around the axle may unwind freely unless restrained by the release brake. A release member, preferably a non-circular release ring surrounds the inertial ring and the movable member. The release ring is spring biased not to engage the inertial ring or the movable member. A release cord extends from the release ring. When the release cord is pulled the release ring turns and grips and rotates inside the fixed member around an axis parallel to the axis of the axle gripping and turning the inertial ring and the movable member. This motion disengages the release brake from the surface of the axle. The end of the axle, or a stub shaft connected to the axle, extends through central bores in the movable member and the inertial ring to a post extending from the stationary member. With the release brake disengaged, the axle is free to rotate around the post.

The present preferred release brake has a movable member similar to the inertial ring which is positioned adjacent the inertial ring. This movable member has a central bore through which the roller passes. A second spring having a selected diameter is fitted within the movable member and lightly rubs the exterior surface of the axle. A first tang at one end of the spring is attached to the stationery member at an end opposite the end which supports the post. If the axle rotates in a direction which would lower the shade the spring in the release brake tightens to grip the axle and prevent it from turning. The axle is free to turn in an opposite direction to raise the shade.

A flat coiled spring is provided within the spool. One end of the spring is connected to the post and the second end of the spring is attached to the spool. When a cord wound on the spool is pulled to raise the shade the spool turns tightening the spring similar to the common tape measure. At the same time a tab extending from the spool engages the tang of the first helical coil spring which grips the axle and causes it to rotate to raise the shade or blind connected to the axle. When the spool cord is released the wound spring within the spool relaxes turning the spool in an opposite direction to rewind the spool cord around the spool. As the spool rewinds the first spring and the inertial ring will rotate in the same direction as the spool and the first spring within the inertial ring is expanded and passes freely around the roller. However, the movable member does not turn because the inertial ring is not connected to the movable member. Consequently, the axle is held by the spring of the movable member while the spool cord rewinds. One advantage of this arrangement is that only a single cord with no loop is needed to raise the shade. This cord can be relatively short such that multiple pulls and rewinds would be required to raise the shade from a fully lowered position to a fully raised position. Another advantage is that the spool and inertial ring arrangement can be used with the different embodiments of release brakes particularly those disclosed in my U.S. Pat. Nos. 5,791,393 and 5,927,370 as well as in my published application WO 99 25946.

To lower the shade one pulls a release cord attached to the release ring. This causes the release ring to grip and turn both the movable member and the inertial ring allowing the respective springs which surround and grip the axle to expand their diameter. This allows the axle to rotate freely. The weight of the shade will cause it to fall. When the shade reaches the desired position, the user lets go of the release cord. The two helical springs or an additional spring connected to the release ring pulls it to a more relaxed position where it does not engage either the inertial ring or the movable member. A governor can be attached to the axle to assure that the shade does not fall too fast.

Other details, objects and advantages of my invention will become apparent from the following description and the accompanying drawings of certain presently preferred embodiments thereof.

BRIEF DESCRIPTION OF THE DRAWINGS

In the accompanying drawing figures, certain preferred embodiments of the invention are illustrate in which.

DETAILED DESCRIPTION OF THE PREFERRED EMBODIMENTS

Figure 1:
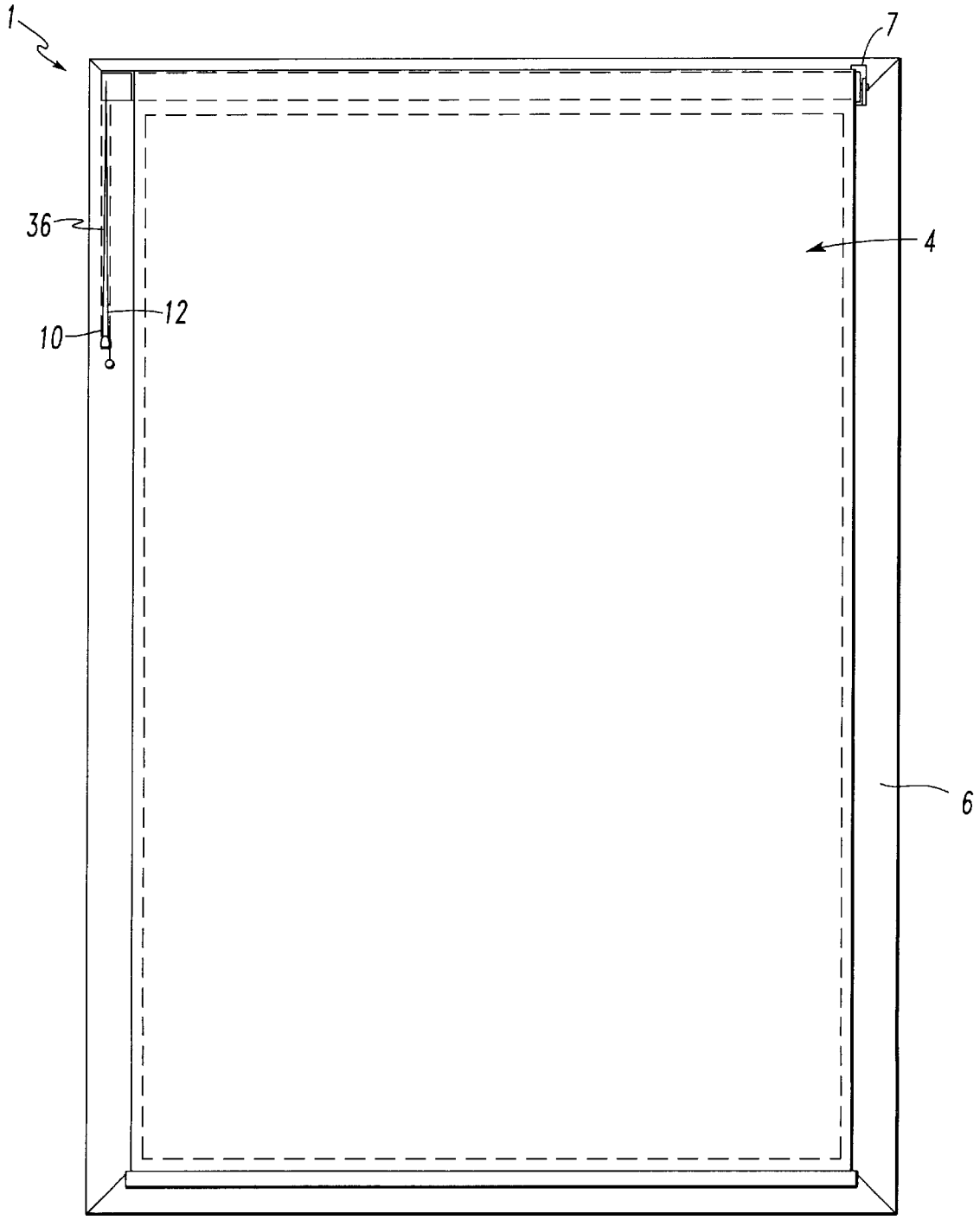
FIG. 1 is a front view of a roller shade containing a present preferred shade operator in a fully lowered position.
Figure 2:
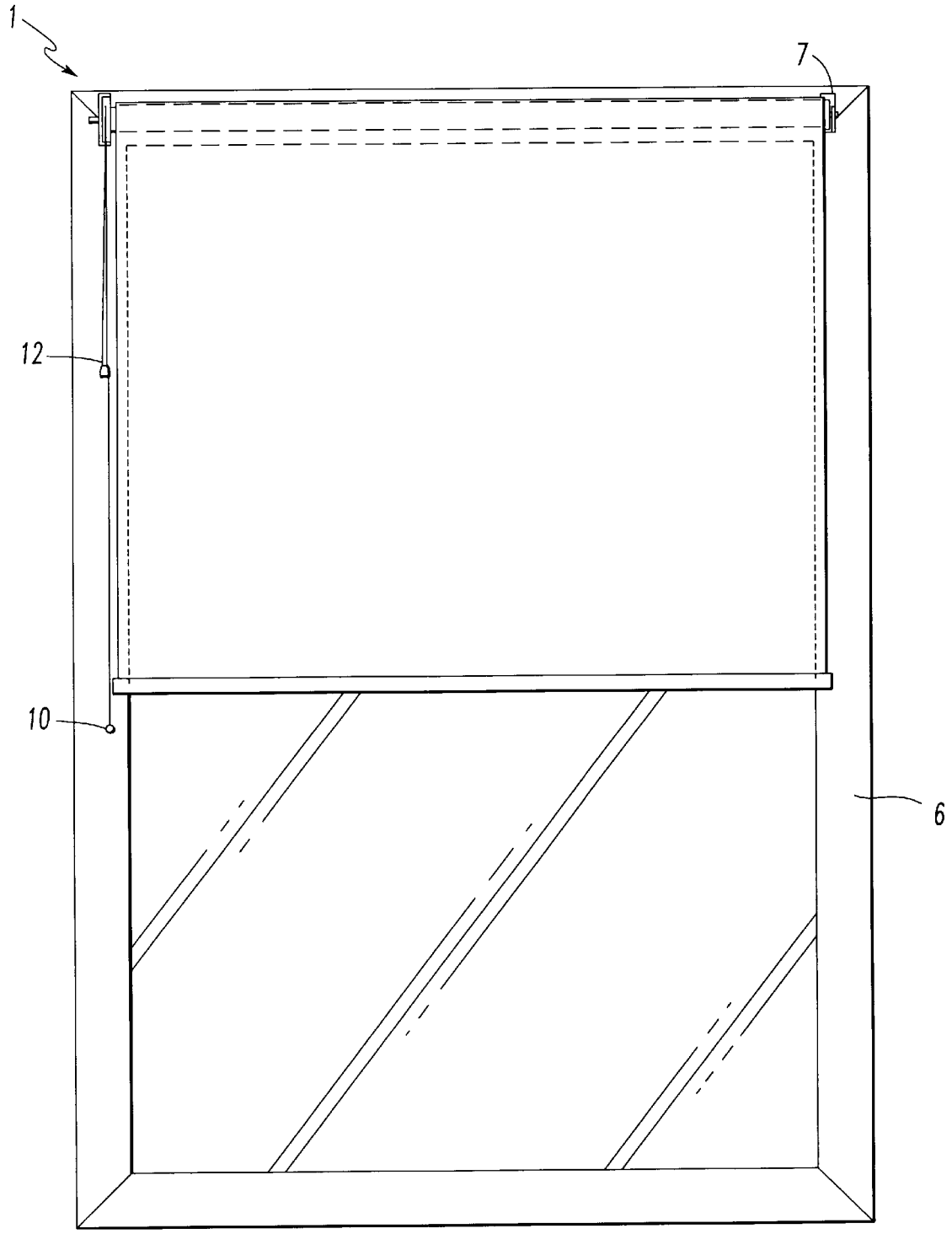
FIG. 2 is a front view similar to FIG. 1 showing the roller shade in a partially lowered position.
Figure 3:
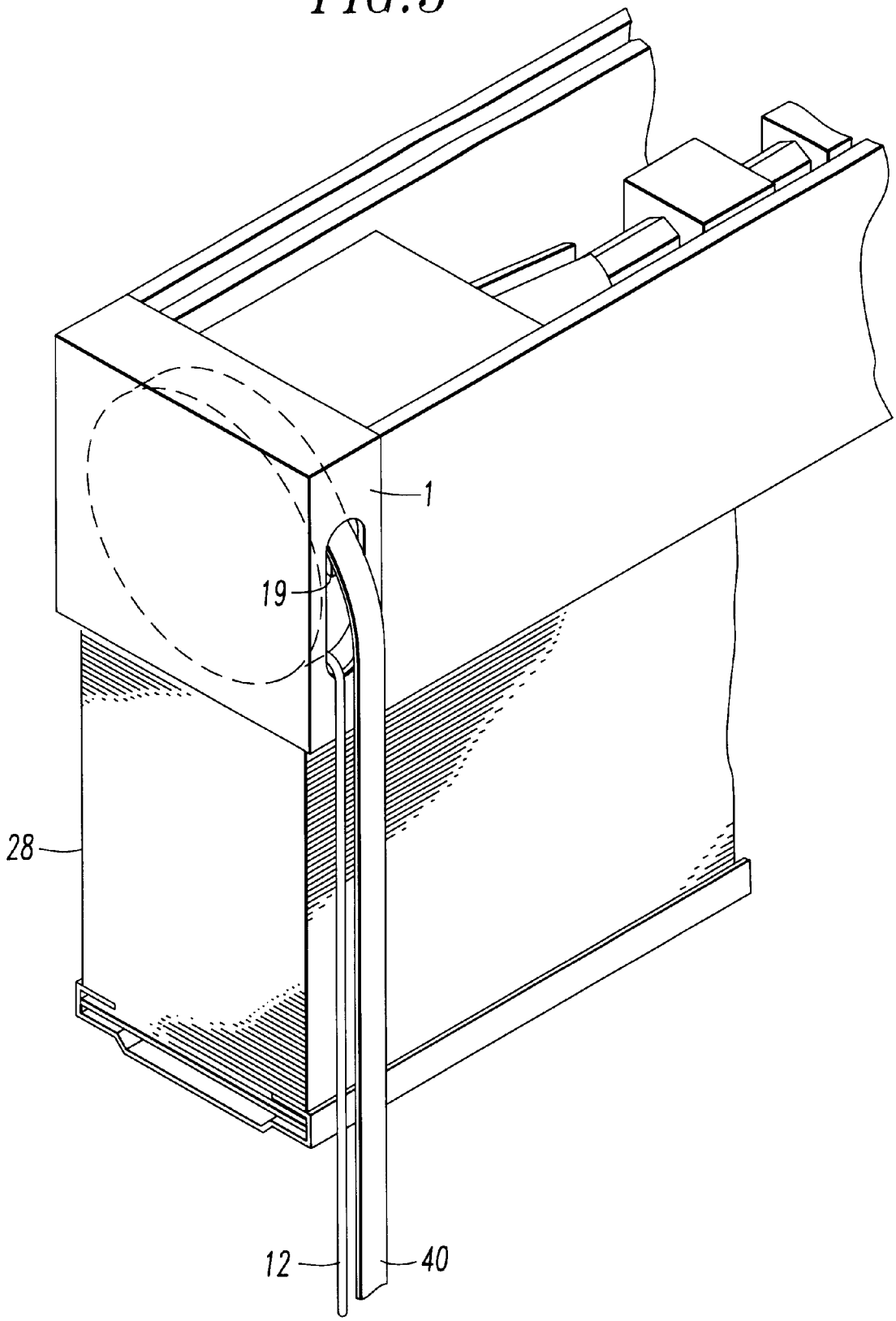
FIG. 3 is a front perspective view of an end portion of a pleated shade in a fully raised position which shade contains a present preferred release brake that utilizes a release cord.
Figure 4:
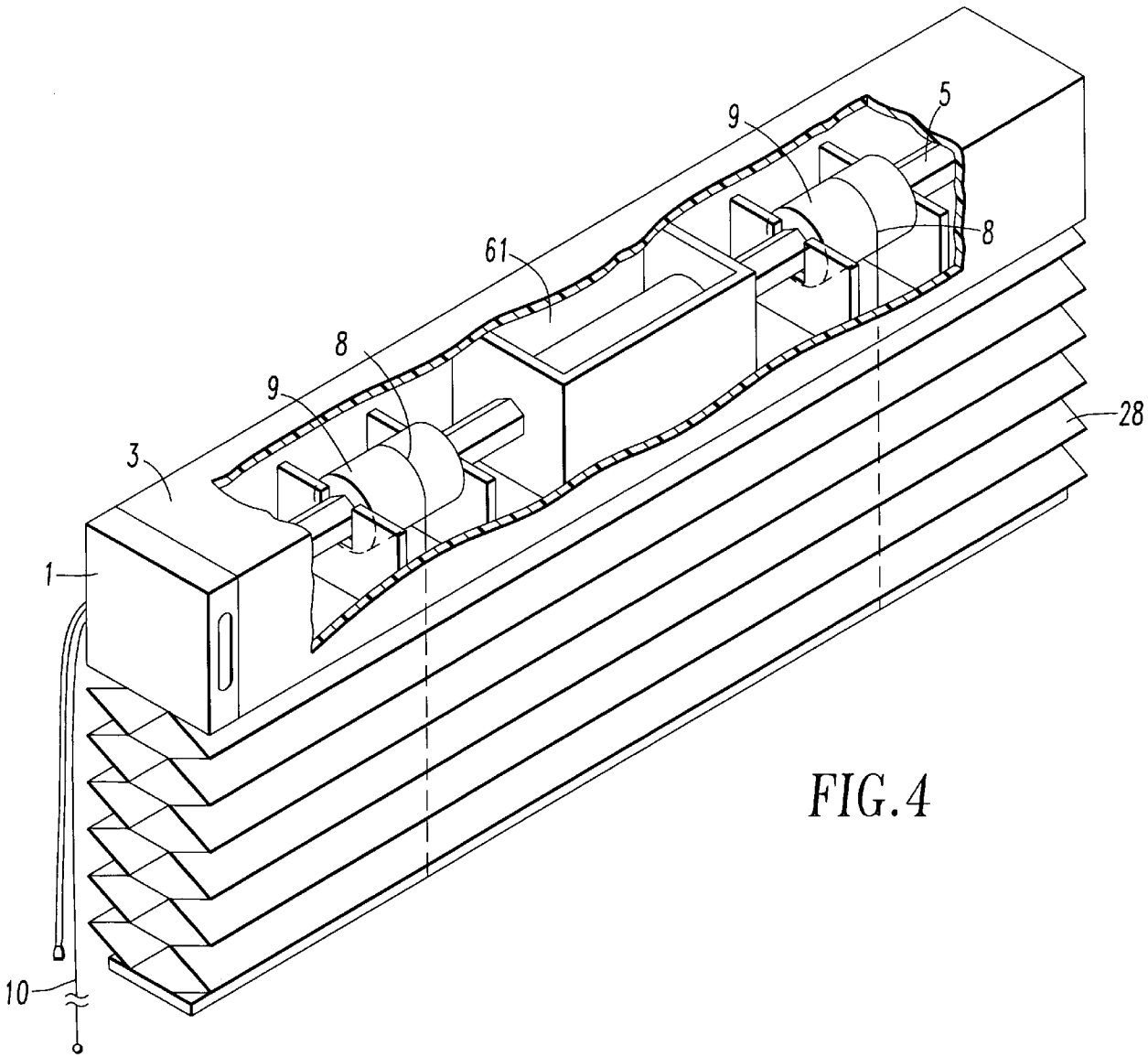
FIG. 4 is a rear perspective view of a pleated shade similar to the pleated shade of FIG. 3 shown in a lowered position and with the headrail partially cut away to show the central shaft and take up spools for the lift cords.
Figure 5:
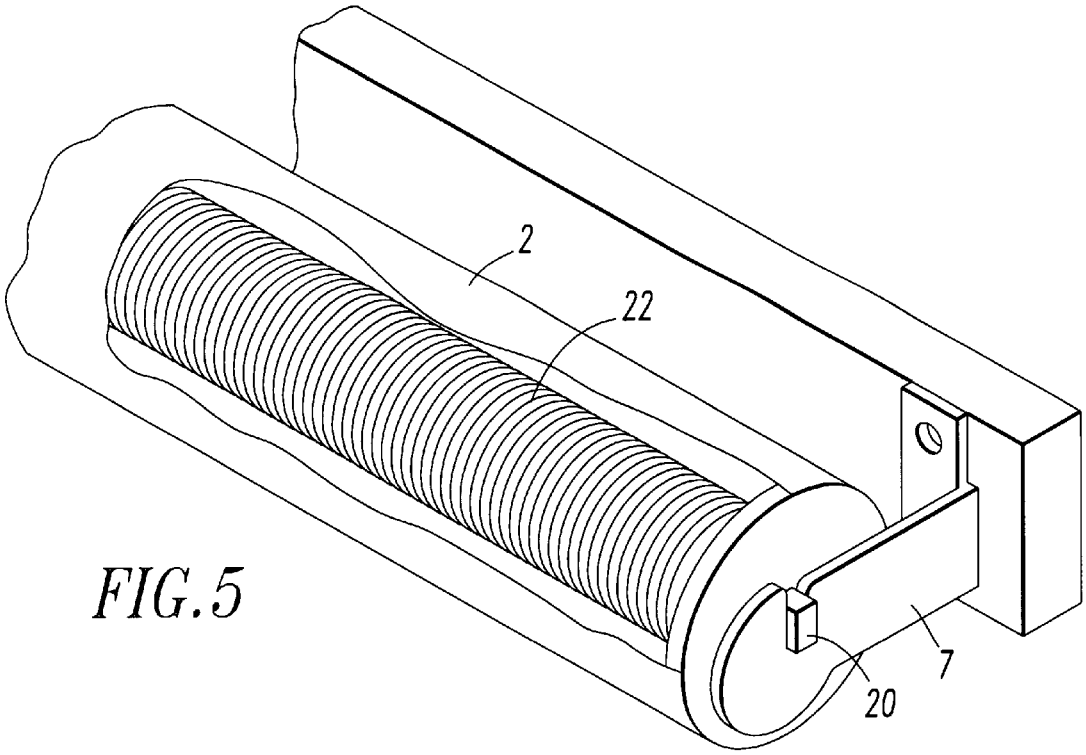
FIG. 5 is an end view partially cut away of a roller shade showing a counterbalance spring within the shade.

I provide a shade operator having a release brake 1 that may be used in conjunction with a roller shade 4 such as shown in FIGS. 1 and 2 or a shade lifted by cords such as a pleated or cellular shade 28 such as shown in FIGS. 3 and 4. When used in a roller shade, the shade operator 1 is provided at one end of the roller shade. This shade is mounted on window frame 6 by bracket 7. An optional counteracting spring 22 is provided within the roller at the end opposite my shade operator. As can be seen most clearly in FIG. 5 there is a spring axle 20 which fits within a slot in the bracket 7. This connection keeps the spring axle 20 stationary while the roller 2 may rotate around stationary roller axle 20. One end of the counteracting spring is attached to roller 2 while the opposite end is attached to a stationary axle 20. The spring is in a relaxed position when the shade is somewhere in between the fully raised and fully lowered position. This may be higher or lower than shown in FIG. 2. One way to accomplish this is to disengage the axle 20 from the bracket when the window covering is at the desired position. The spring unwinds to a relaxed state and the axle 20 is replaced onto the mounting bracket after the spring has unwound. The spring 22 winds when the shade is moved up or down from the neutral position. The spring is not intended to lift the shade, but simply to slow the descent speed and partially counter-balance the load. When the shade is moved up from the neutral position, the spring 22 winds and encourages the shade to descend. This is helpful when the shade is completely raised and wrapped on the roller and the edge of the shade is rubbing against the bracket or spool. In this case, the weight of the shade is insufficient to overcome the friction in the system and lower the shade. The tension in spring 22 can overcome the friction and ensure that the shade descends.

I provide a cord 10 shown in FIG. 4 which is wound on a spool and is used to raise both those blinds having lift cords and those shades having a roller. A tape 40 could be wound around the spool instead of a cord as shown in FIG. 3. When the shade is not being operated or when it is being lowered the cord 10 or tape 40 is in a retracted position in which most of it is rolled around the spool. Consequently, the cord 10 will be out of reach of small children and not pose a safety hazard whether the shade is fully raised, fully lowered or at some intermediate position. A release cord 12 is provided to cause the release ring to release the brake and is used to lower the window covering.

In the pleated or cellular shade 28 shown in FIGS. 3 and 4, the headrail is mounted to the window frame in a conventional manner. The lift cords 8 of the pleated or cellular shade are wound about take-up spools 9 attached to the roller within headrail 3 as shown in FIG. 4.

Figure 6:
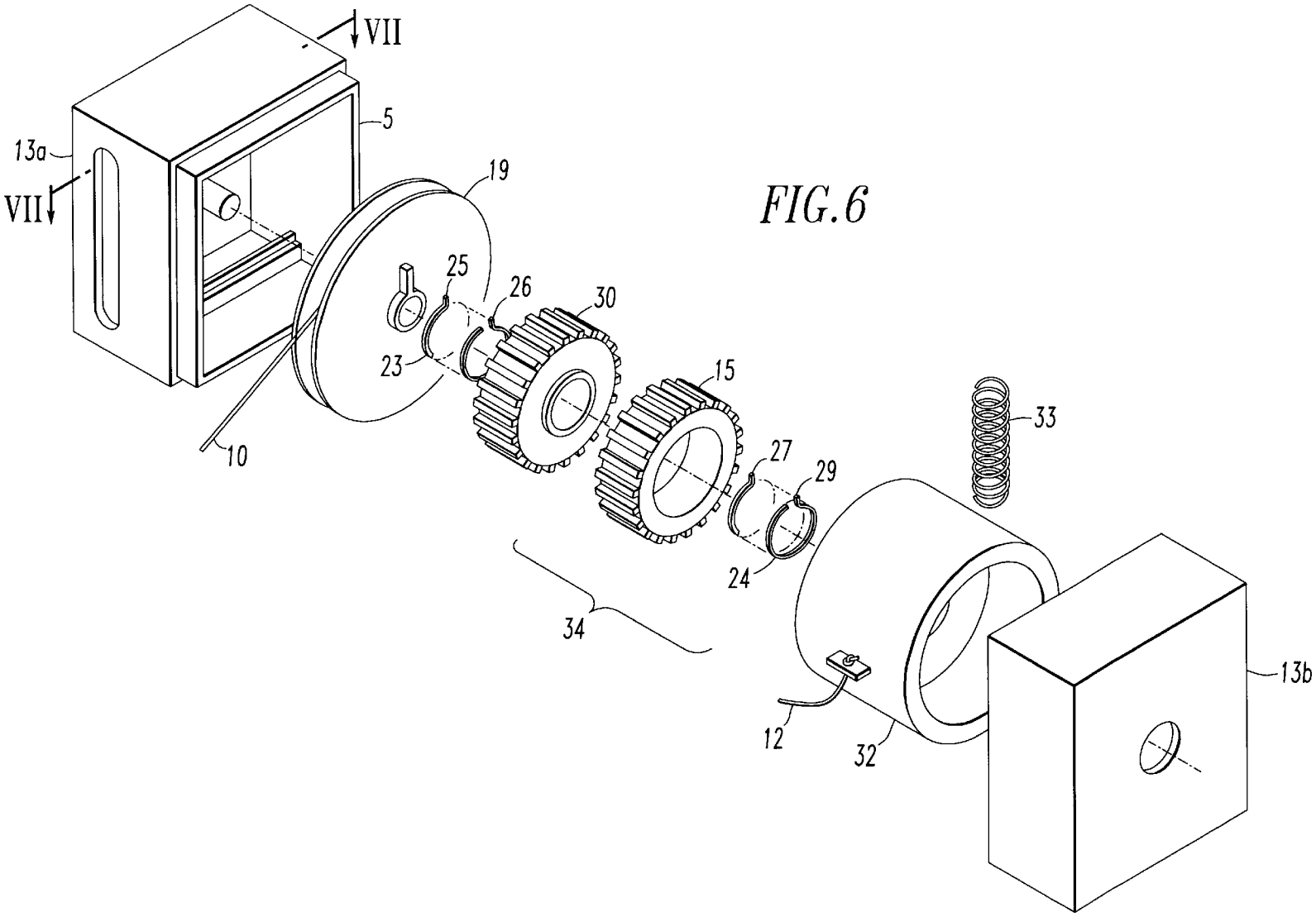
FIG. 6 is an exploded view of the present preferred shade operator with release brake.
Figure 7:
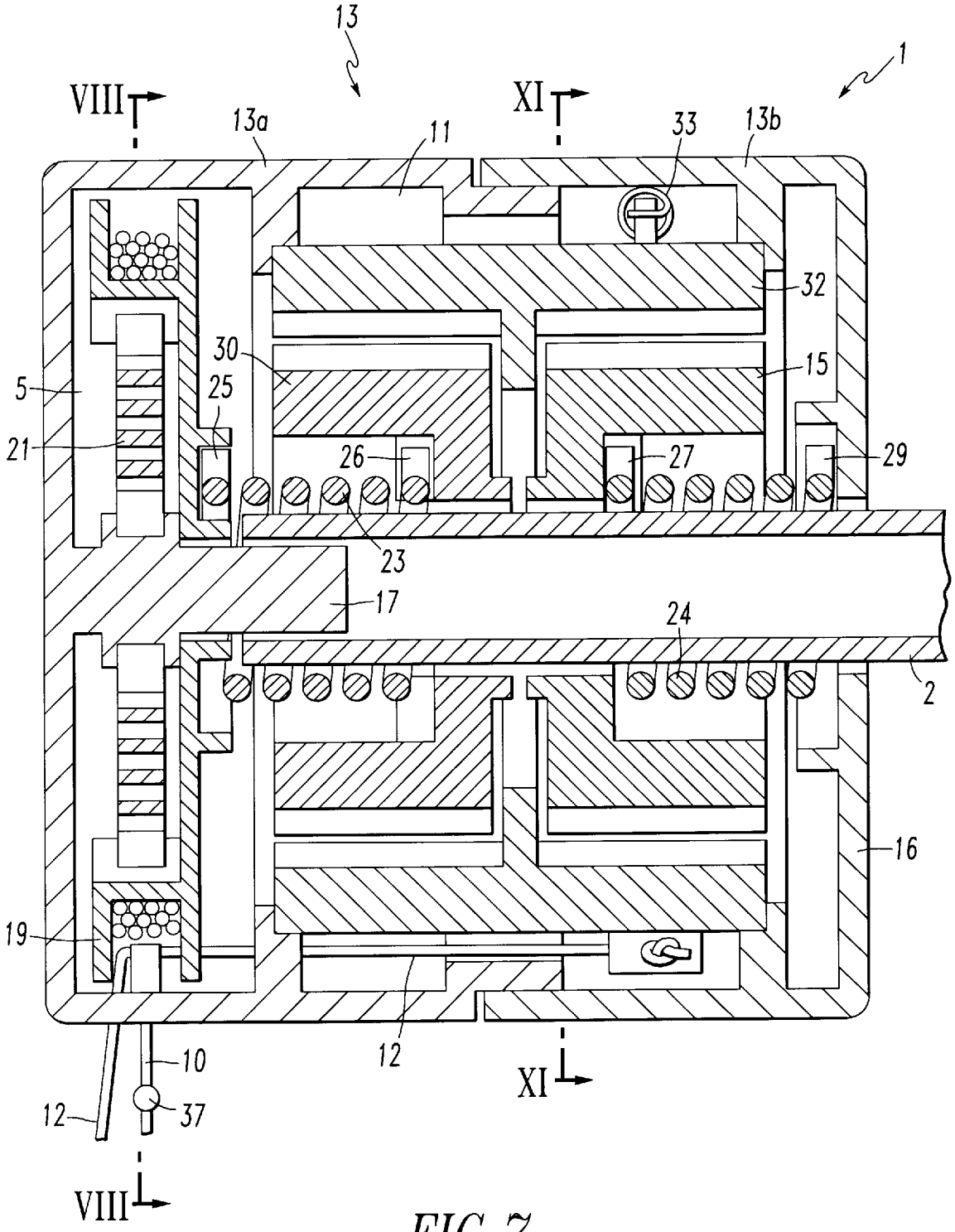
FIG. 7 is a top sectional view of the assembled shade operator taken along line VII—VII of FIG. 6.

Referring now to FIGS. 6 and 7, one present preferred embodiment of my shade operator 1 has a fixed housing 13 with a cylindrical bore 14 in the front face 16. The housing is a stationary member and preferably is made of two pieces 13*a* and 13*b* which snap together to define an interior cavity 11. A post 17 extends from the rear face 5 into the cavity. A release brake has a movable member 15, in the shape of a cylindrical drum, that is rotatably disposed in the cavity 11 and has a bore 39 through which the axle 2 passes. The axle is hollow or has a hollow end which fits over and is free to rotate about post 17. Alternatively, the post may be hollow and receive a solid axle. The spring 24 is located within the movable member. A tang 27 at one end of the spring is attached to the movable member 15. A tang 29 at the opposite end of the spring is attached to the stationary member. The spring 24 lightly rubs against the axle allowing it to freely turn in a direction which will raise the shade.

Figure 14B:
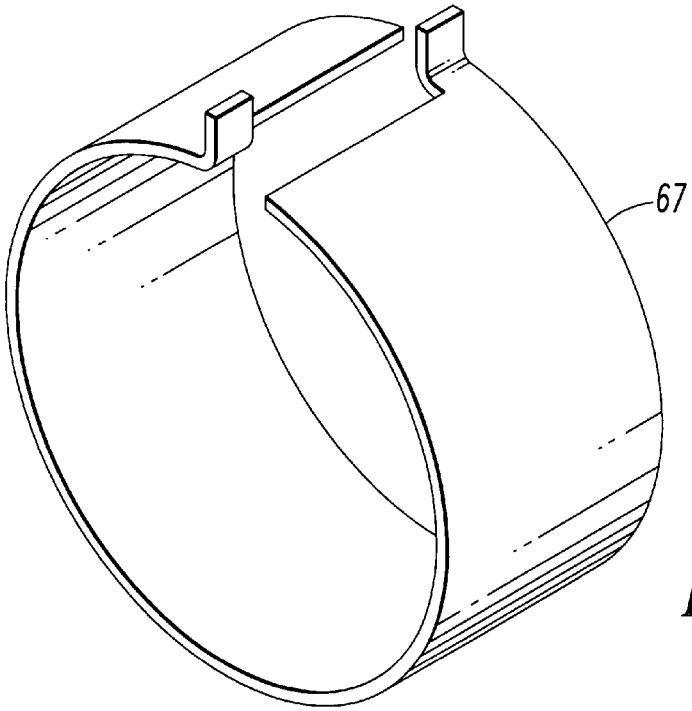
FIGS. 14A and 14B are perspective views of a present preferred springs that can be used in the shade operator.
Figure 8:
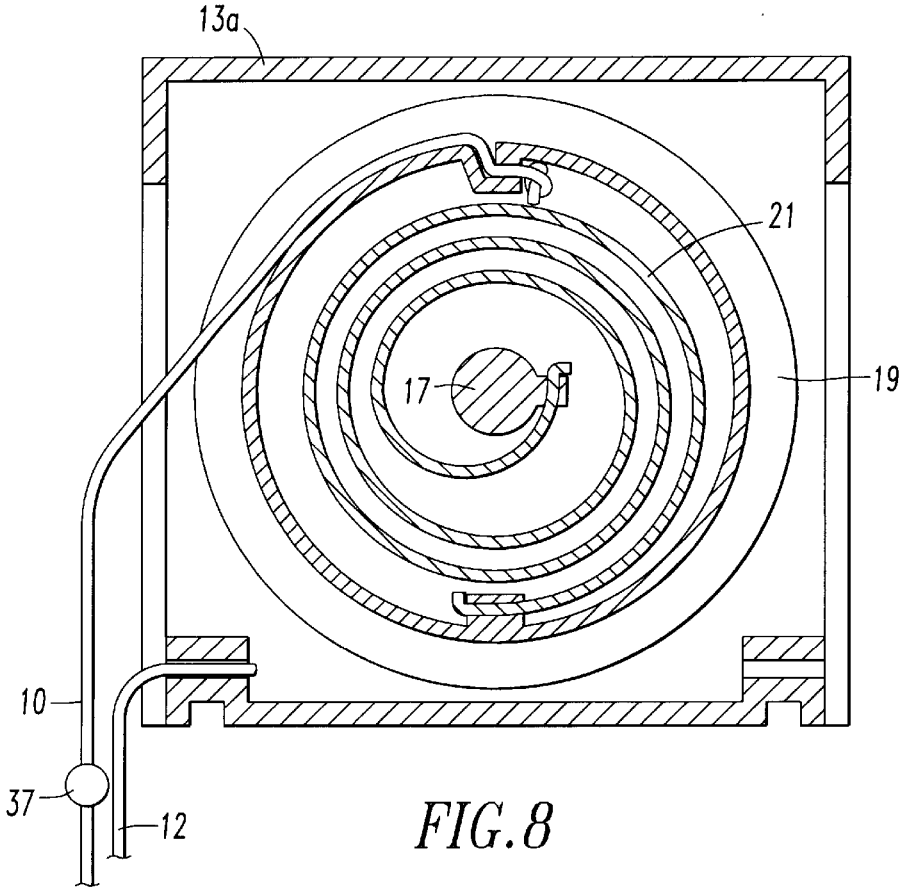
FIG. 8 is a sectional view of the spool taken along the line VIII—VIII of FIG. 7.
Figure 9:
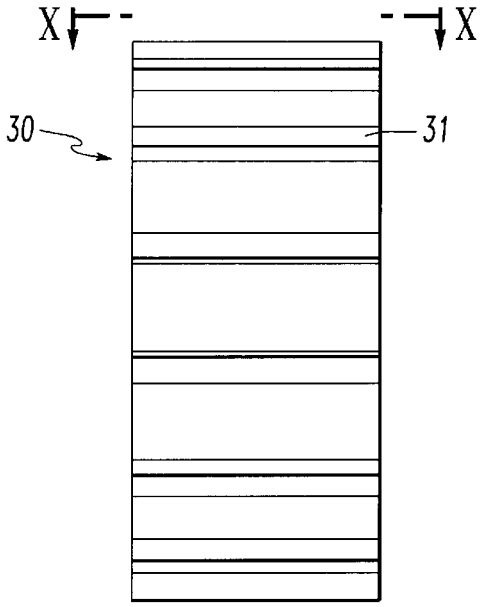
FIG. 9 is an edge view showing the outer diameter of the inertial ring.
Figure 10:
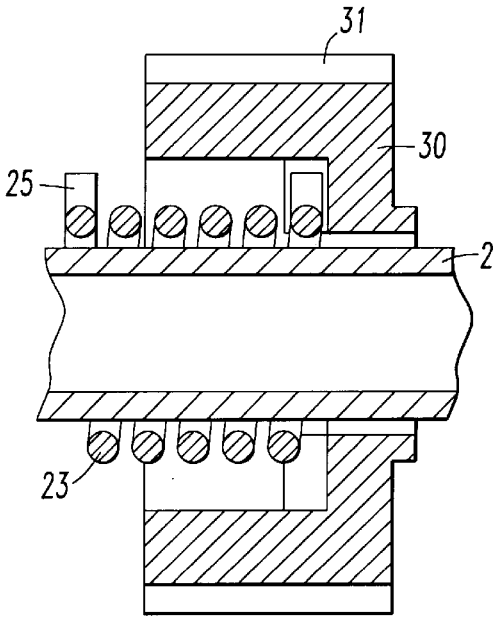
FIG. 10 is a sectional view of the inertial ring mounted on the axle taken along the line X—X in FIG. 9.
Figure 14A:
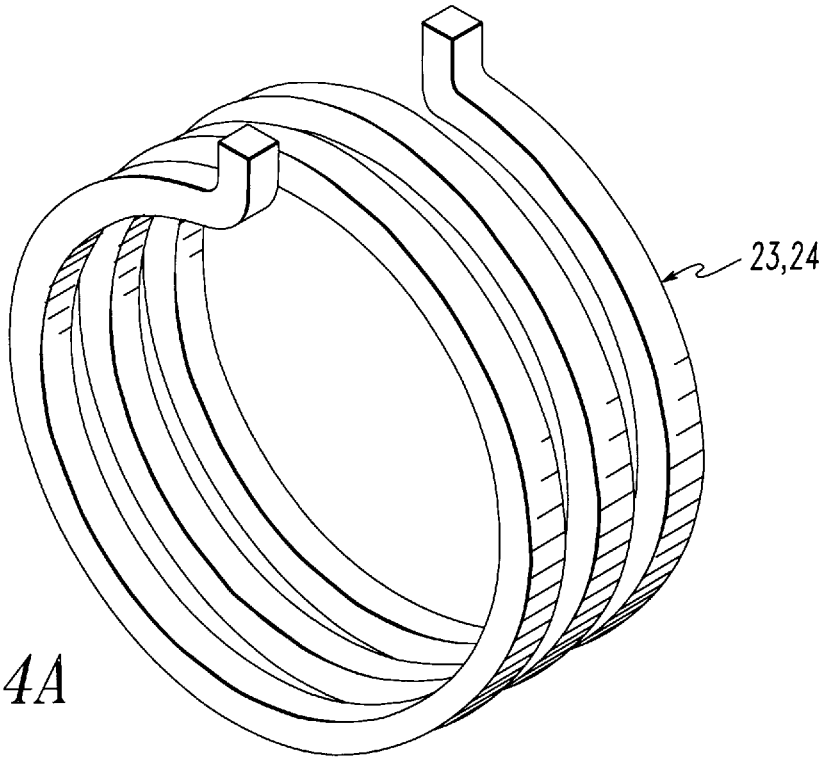

If the axle turns in an opposite direction the spring will grip the axle preventing the shade from lowering. This operation is more fully described in my U.S. Pat. Nos. 5,791,393 and 5,927,370 and my published patent application WO 99/25946. Those patents and the published application also disclose other embodiments of the release brake which could be used. The axle 2 also extends through an inertial ring 30 within the fixed housing 13. A spool 19 is rotatably mounted on post 17. A spring 21 is provided within the spool 19. As shown in FIG. 8, one end of the spring 21 is attached to the spool 19 and the opposite end of the spring is attached to the post 17. When the spring 21 is in a more relaxed position the cord 10 is wound about the spool. As the spool cord 10 is unwound the spring tightens. When that cord is released the spring 21 relaxes turning the spool and winding the cord 10 about the spool. I prefer to provide a cord ball 37 or shroud 36 shown in dotted line in FIG. 1 on the cord 10 so that spring 23 will still be in tension when the cord is rewound and to fix the spool and the spring within the inertial ring. The inertial ring will turn with the spool but slip over the axle without affecting the movable member of the release brake or the release ring which do not turn. A spring 23 is provided within the inertial ring and is positioned around the axle 2. The spring 23 is similar to the spring 24 positioned within the movable member 15 and around the axle 2. Each of the springs 23 and 24 is preferably a coil spring as shown in FIG. 14A, but a spring 67 formed from a flat coil, as shown in FIG. 14B, could also be satisfactorily employed. Tang 25 of spring 23 is attached to the spool and tang 26 is attached to the inertial ring 30. The inside of the diameter of each spring 23 and 24, is sized to lightly grip the outside surface of the axle. When the release ring engages the inertial ring and the movable member, it increases the diameter of the springs. When it is turned the other way it does nothing. When either or both of the movable member and the inertial ring are moved in one direction the tangs move to reduce the diameter of the attached spring and prevent rotation of the axle. If the inertial ring continues to rotate the axle will turn the inertial ring. When the movable member 15 or inertial ring is rotated in an opposite direction this causes the coils of the attached spring 23 or 24 to open up which allows the axle 2 to rotate freely inside the coil springs 23 and 24. Thus, rotation of the movable member 15 and the inertial ring 32 counter clockwise releases the axle allowing the axle to freely rotate. In that condition the window blind is free to fall to a fully lowered position or a kickoff and counterbalance spring attached to the axle will unwind turning the axle.

Figure 11:
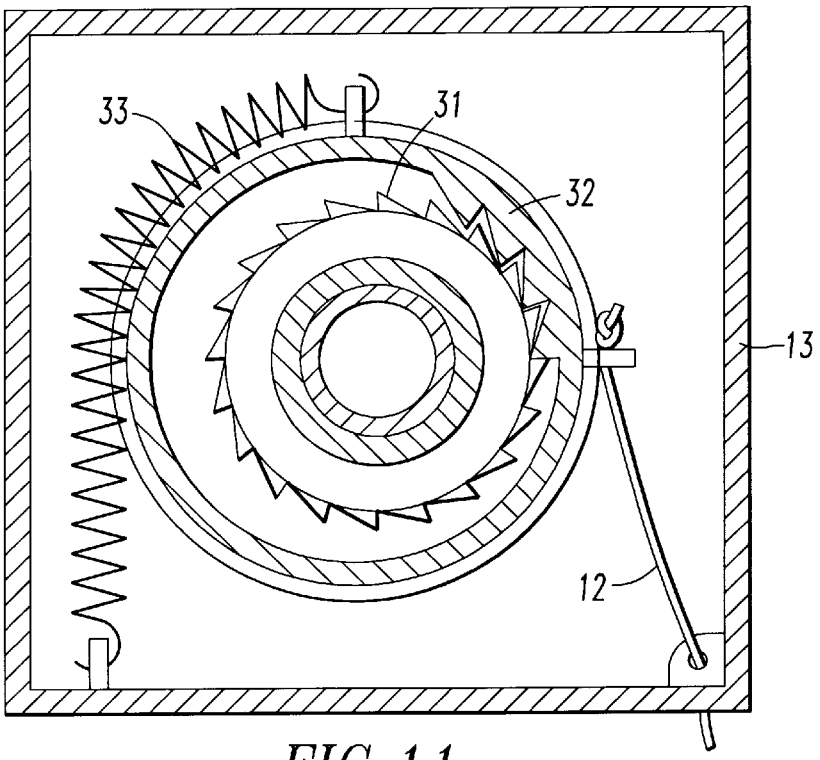
FIG. 11 is a sectional view taken along the line XI—XI of FIG. 7 showing the release in an engaged position.
Figure 12:
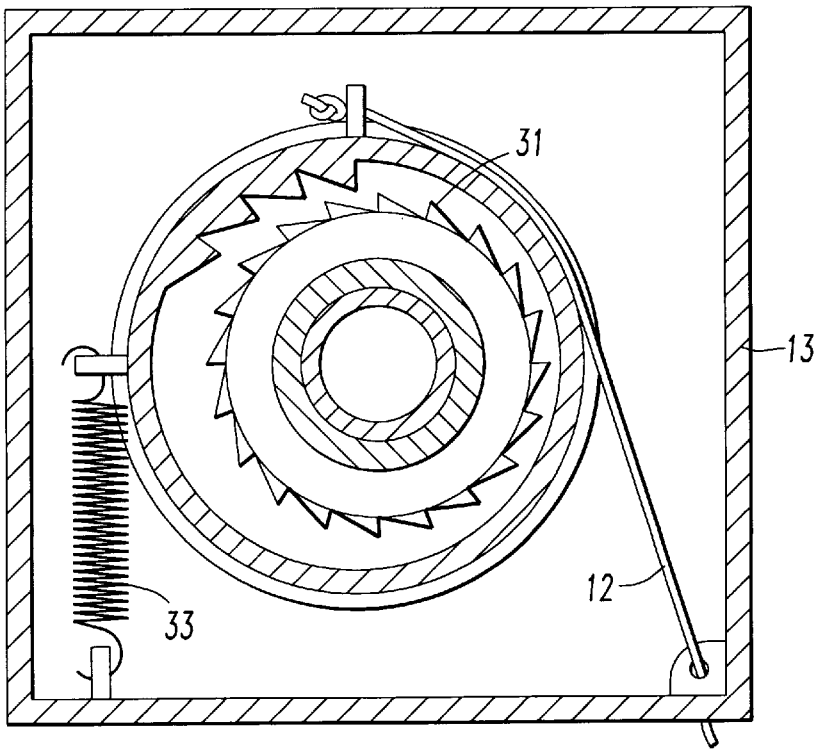
FIG. 12 is a sectional view similar to FIG. 13 showing the release member in the disengaged position.

A release cord 12 is attached to release ring 32. Pulling downward on the release cord 12 causes the release ring 32 to rotate from the open position shown in FIG. 12 to the engaged position shown in FIG. 11. When the release ring rotates it or engages the movable member and inertial ring and turns them which turns the tangs and expands the springs 23 and 24. This allows axle 2 to turn freely allowing the shade to descend. The teeth 31 shown in FIGS. 9, 10, 11 or 12 or other material can be provided on the exterior of the movable member and the inertial ring and the interior of the release ring to improve the gripping action of the release ring.

Figure 13:
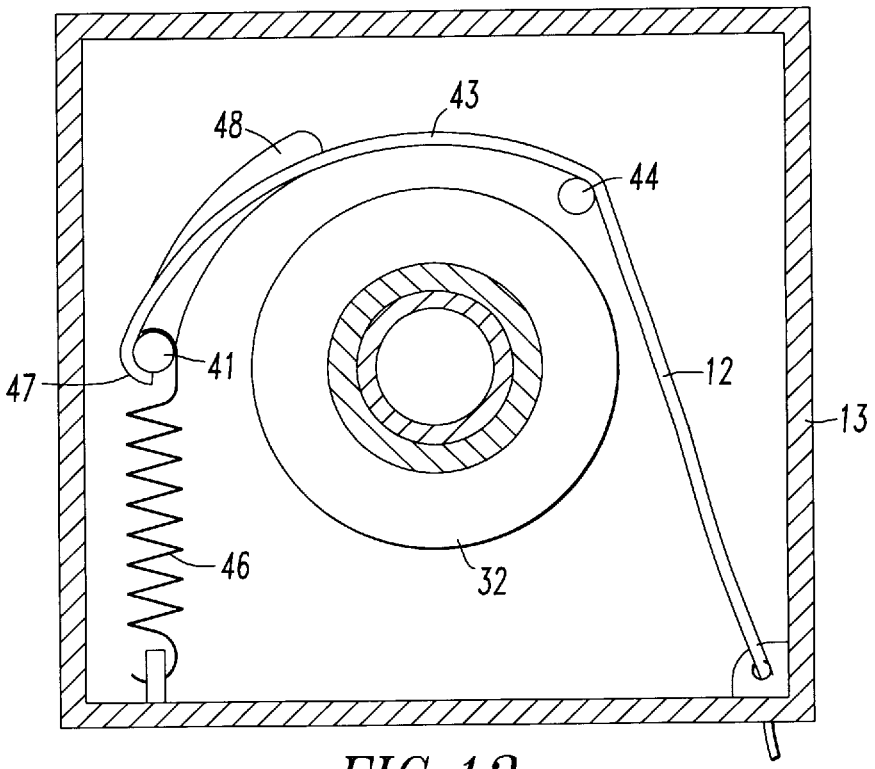
FIG. 13 is a sectional view similar to FIG. 12 showing an alternate embodiment in which a strap is used in place of the release ring.

In an alternative embodiment shown in FIG. 13, I provide a strap and split sleeve 40 in place of the release ring 30. One end 41 of the strap is attached to the stationery member or housing 13. The strap passes the split sleeve which in turn surrounds around the inertial ring 30 and movable member 15 and then the strap extends out of the headrail. The sleeve has enough resilience to keep it away from the inertial ring and movable member. Pulling the strap causes the strap to grip and turn the sleeve which grips and turns the inertial ring 20 and movable member 15.

I prefer to provide a governor 61 which may also include a travel limiting mechanism on the axle as shown in FIG. 4. This controls the descent rate of the shade. The travel limiting mechanism may include a fixed housing or rack which is attached to the headrail 3. Such a mechanism is described in my U.S. Pat. No. 5,927,370 and my published patent application WO 99/25946.

Figure 15:
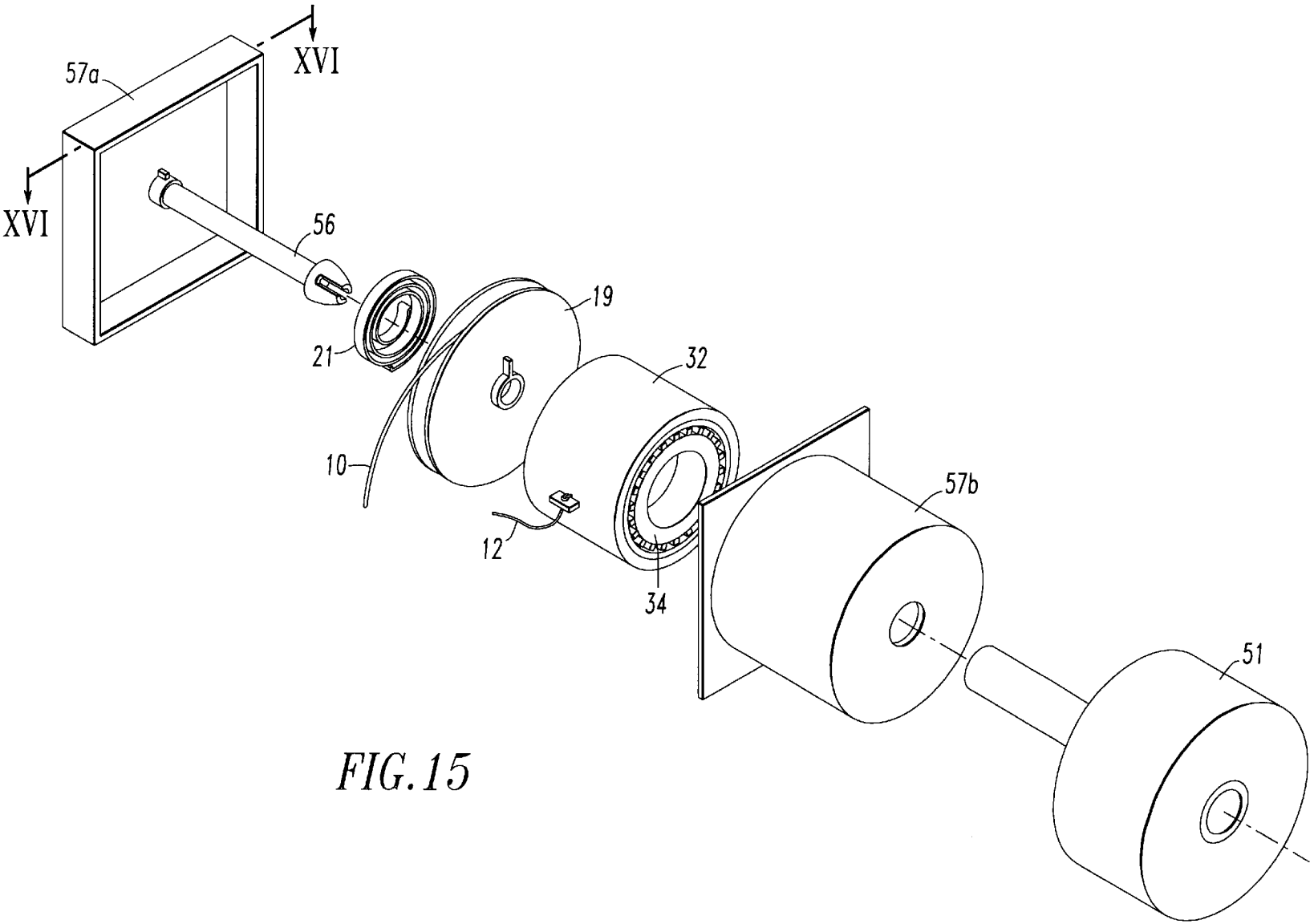
FIG. 15 is an exploded view showing a second preferred embodiment of my shade operator shaped to receive one end of a roller shade.
Figure 16:
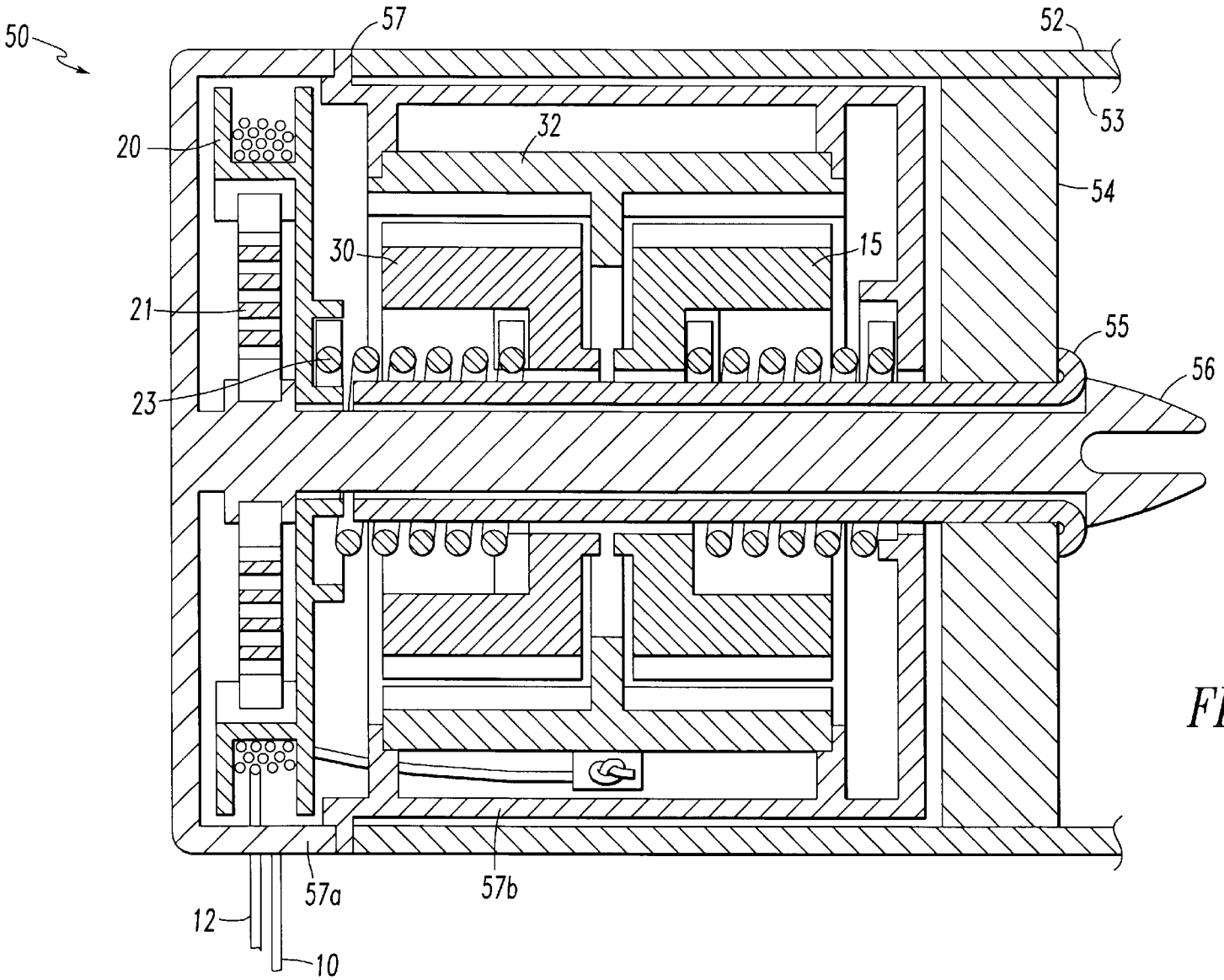
FIG. 16 is a sectional view taken along the line XVI—XVI of FIG. 15.

A second preferred embodiment shown in FIGS. 15 and 16 is particularly configured to receive the end of a hollow roller tube 51. A plug 54 is attached between the inside surface 53 of the roller 52 and hollow axle 55. Thus, axle 55 will turn with the roller 52. Axle 55 fits over post 56 so that it can freely turn about the post unless restrained by coil springs 23 and 24. The shade operator 50 has a mechanism which is identical to the first embodiment with the housing 57 being configured somewhat differently to receive the roller tube 51. The housing preferably is formed in two pieces 57*a* and 57*b* which snap together. This embodiment operates in the same way as the previous embodiment. Therefore, like reference numbers are used for like parts in both embodiments.

While specific embodiments of my invention have been described in detail, it will be appreciated by those skilled in the art that various modifications to those details could be developed in light of the overall teachings of the disclosure. Accordingly, the particular embodiments disclosed herein are intended to be illustrative only and not limiting to the scope of my invention which should be awarded the full breadth of the following claims and all embodiments thereof.

I claim:

1. An operator for a window covering of the type having at least one axle about which one of a window covering material and lift cords are wound comprising:

a stationary member having a central cavity and a first bore sized and positioned so that the roller can pass through the bore into the central cavity;

a release brake having a release brake bore aligned with the first bore of the stationary member, the release brake bore sized and positioned so that the roller can pass through the second release brake bore;

an inertial ring within the central cavity of the stationary member, the inertial ring having an inertial ring bore aligned with the bores of the release brake and the stationary member, the inertial ring bore sized so that the axle may pass through the inertial ring bore;

a release member adjacent the release brake and the inertial member, the release member sized and positioned so that when the release member is in a first position the release member will not engage the inertial ring or the release brake and when the release member is moved in a selected direction the release member will engage and turn the release brake and the inertial ring;

a spool within the central cavity of the stationary member adjacent the inertial ring;

a coil spring positioned to encircle an axle passing through the inertial ring bore, the spring having opposite ends, one end attached to the spool and the opposite end attached to the inertial ring;

a rewind spring connected between the spool and the stationary member such that when a force acts on the spool to turn the spool in the first direction from an initial position the rewind spring will tighten and when the force is removed the spring will loosen causing the spool to return to the initial position; and an operator attached to the release member to enable an operator to turn the release member.

2. The operator of claim 1 also comprising a cord attached to the spool in a manner to be wound and unwound around the spool.

3. The operator of claim 2 also comprising a cord stop attached to the cord.

4. The operator of claim 1 also comprising a bias spring connected between the release member and the stationary member biasing the release member to the first position.

5. The shade operator of claim 1 wherein the release brake is comprised of a movable member which contains the release brake bore and a spring having opposite ends and positioned within the release brake bore, one end of the spring attached to the movable member and the opposite end attached to the stationary member.

6. The shade operator of claim 1 wherein the release brake is comprised of strap having one end connected to the stationery member within the central cavity and a second end extending outside the central cavity of the stationery member.

7. The shade operator of claim 5 also comprising a bias spring connected between the stationery member and the strap.

8. The shade operator of claim 1 also comprising teeth attached to the inertial ring and positioned to be engaged by the release ring.

9. The shade operator of claim 1 also comprising teeth attached to the release brake and positioned to be engaged by the release member.

* * * * *